United States Patent [19]

Sabb

[11] 4,079,881

[45] Mar. 21, 1978

[54] PICTURE POSTCARD

[76] Inventor: Acie J. Sabb, P.O. Box 344, Surry, Va. 23883

[21] Appl. No.: 806,690

[22] Filed: Jun. 15, 1977

[51] Int. Cl.[2] ..... B42D 15/00

[52] U.S. Cl. ..... 229/92.8; 40/158 R

[58] Field of Search ..... 229/92.8; 40/158 R

[56] References Cited

U.S. PATENT DOCUMENTS

| | | | |
|---|---|---|---|
| 2,576,667 | 11/1951 | Bly | 40/152 |
| 3,190,541 | 6/1965 | McLaughlin et al. | 229/92.8 |
| 3,346,172 | 10/1967 | Tucker | 229/92.8 |
| 3,370,365 | 2/1968 | Vosbikian | 40/158 R X |
| 3,381,402 | 5/1968 | Ohfuji | 40/158 R |
| 3,386,199 | 6/1968 | Nagatsuka | 40/158 R |
| 3,677,399 | 7/1972 | Tatar | 206/46 AM |
| 3,736,685 | 6/1973 | Shibata | 40/158 R |
| 3,762,630 | 10/1973 | Braznell | 229/92.8 |
| 3,822,495 | 7/1974 | Ohfuji | 40/158 R |
| 3,847,325 | 11/1974 | Nasalski et al. | 229/92.8 |
| 3,857,192 | 12/1974 | Mascolo | 40/158 R |
| 3,894,684 | 7/1975 | Florey | 229/92.8 |
| 3,986,283 | 10/1976 | Palaez | 40/125 A |
| 4,008,852 | 2/1977 | Davis | 229/92.3 |

FOREIGN PATENT DOCUMENTS

| | | | |
|---|---|---|---|
| 191,725 | 9/1957 | Germany | 229/92.8 |

*Primary Examiner*—Stephen P. Garbe
*Attorney, Agent, or Firm*—Bacon & Thomas

[57] ABSTRACT

A postcard includes a relatively rigid panel made of cardboard, or the like, having a writing surface on one side thereof and a photograph display surface on the other side thereof. The photograph display surface has a layer of adhesive thereon to which is secured a clear plastic sheet beneath which a photograph is secured. By using this postcard, one may mail any photograph desired. The postcard is especially convenient and useful in mailing self-developing photographs.

9 Claims, 6 Drawing Figures

Dear John
Today we
Mr. John Burns
MD.
21202
17
19
21
14
25
14
12
13
11
26
10
28
16
18
14a
14b
11
34
4
35
10
14
11a
17
11b
4
14
11
34
35
10
11a
11b
14
34
40
35
10
35
12
22
23

PICTURE POSTCARD

BACKGROUND OF THE INVENTION

1. Field of the Invention

The instant invention relates to postcards, and more particularly the instant invention relates to postcards for mailing separately made photographs.

2. General Considerations and Prior Art

In recent years, cameras which take photographs with self-developing film have come into wide use. Consequently, people are able to take a photograph at a particular location and have the photograph fully developed within several minutes. Often, people wish to share an experience with their friends or acquaintances by mailing a picture conveying that experience to their friends or acquaintances. Consequently, a huge market has developed for picture postcards in which rather standard photographs are sold illustrating locations or events of interest. These photographs are, or course, rather impersonal and necessarily exclude the person mailing the postcard or any people that the person might wish to include in the photograph. Accordingly, there is a need for postcards which will allow one to utilize a personal photograph with the postcard.

The foregoing problem is recognized in the prior art and several approaches to solving the problem have been attempted. For example, U.S. Pat. No. 3,847,325 and 3,894,684 both disclose postcards for mailing pictures. Both of these postcards are relatively complex structures and neither have achieved sufficient acceptance so as to be widely available to the public.

In addition to the foregoing patents, the following patents are also considered to be of interest as being exemplary of development in this area:

| | |
|---|---|
| 2,576,667 | Bly |
| 3,190,541 | McLaghlin |
| 3,346,172 | Tucker |
| 3,677,399 | Tatar |
| 3,762,630 | Braznell |
| 3,822,495 | Ohfuji |
| 3,986,283 | Pelaez |
| 4,008,852 | Davis |

In view of the foregoing considerations, there is need for an approach to this concept which will achieve wide commercial acceptance so that people may derive more enjoyment from their self-developed photographs and may communicate more effectively with the use of postcards.

SUMMARY OF THE INVENTION

In view of the foregoing considerations, it is an object of the instant invention to provide a new and improved postcard for mailing photographs.

It is a further object of the instant invention to provide a new and improved postcard for mailing photographs wherein the postcard is of a relatively simple construction and is inexpensive to manufacture.

It is a further object of the instant invention to provide a new and improved postcard for mailing photographs wherein the postcard can achieve wide commercial acceptance.

It is a further object of the instant invention to provide a new and improved postcard for mailing photographs wherein the photograph is readily removable from the postcard after the postcard is received.

It is a further object of the instant invention to provide a new and improved postcard for mailing photographs wherein the photograph may be quickly and easily mounted on the postcard.

It is a further object of the instant invention to provide a new and improved postcard for mailing photographs wherein the photograph is readily visible on the postcard and yet is readily removable therefrom without being readily subject to damage in the mail.

With these and other objects in mind, the instant invention contemplates a postcard which includes a relatively rigid panel having a writing surface on one side thereof and a display surface on the other side thereof. A layer of adhesive is disposed in an outer area of the display surface, while an inner area of the display surface is adhesive-free in order to accommodate a photograph. A plastic cover sheet is placed over the display area and adhered to the adhesive layer in order to hold the photograph in place within the adhesive-free inner area.

The instant invention further contemplates making the adhesive layer of a pressure sensitive adhesive so that the plastic sheet may be readily stripped from the display surface in order to remove the photograph while, at the same time, providing the photograph with a large degree of protection while the postcard is in the mail.

The instant invention further contemplates making the relatively rigid panel in the form of a laminate having front and rear subpanels which are adhered together with a portion of the plastic sheet therebetween so that the plastic sheet may be readily folded down over the photograph after the photograph has been placed on the display surface.

DETAILED DESCRIPTION OF THE DRAWINGS

Figures 1, 2, 3, 4, 5, 6:
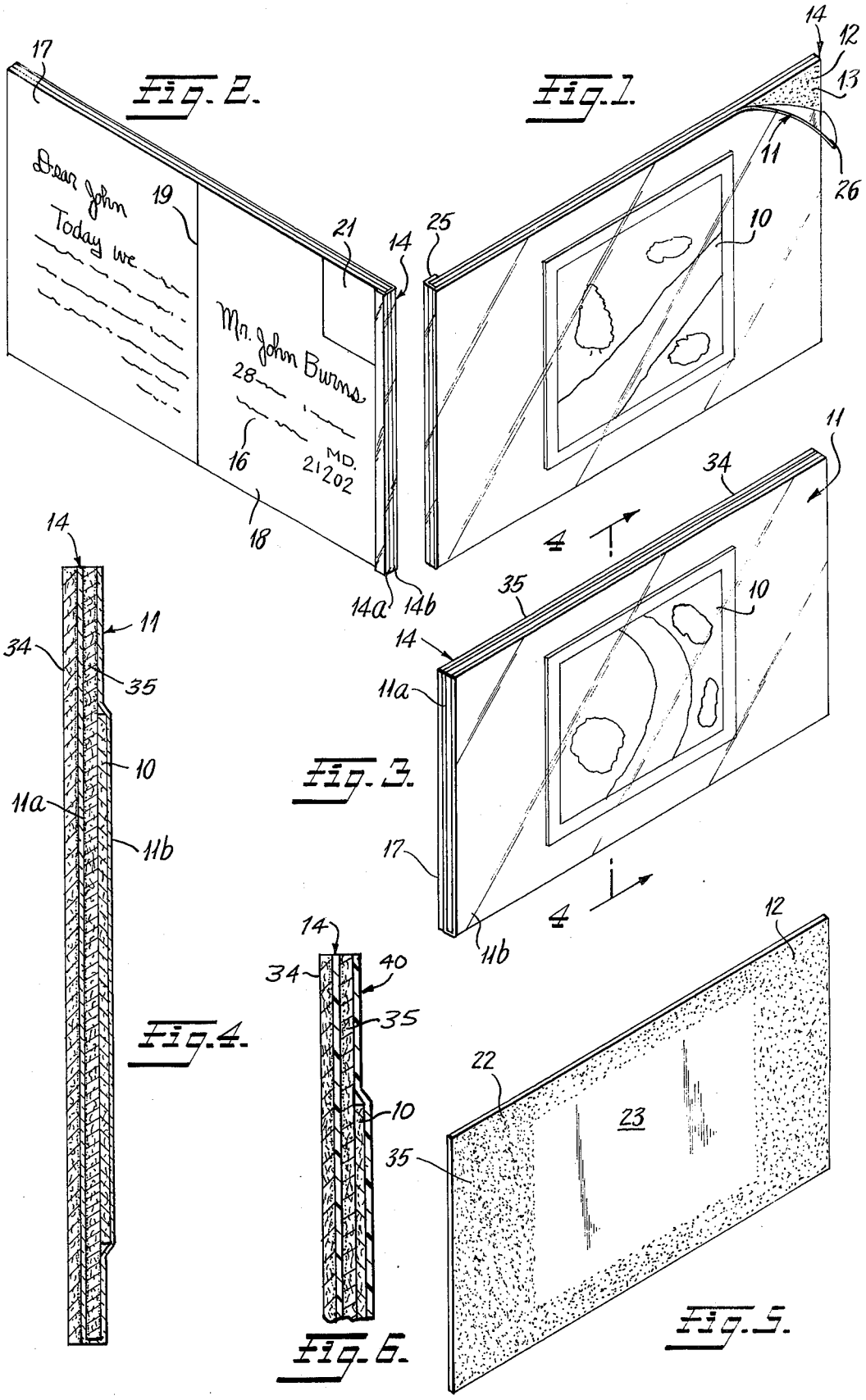
FIG. 1 is a front perspective view of a postcard according to the instant invention.
FIG. 2 is a rear perspective view of the postcard shown in FIG. 1.
FIG. 3 is a front perspective view of a second embodiment of a postcard in accordance with the instant invention.
FIG. 4 is a side view in elevation of a section of the postcard shown in FIG. 3.
FIG. 5 is a front perspective view showing the disposition of adhesive on the surface of the postcard.
FIG. 6 is a side view in elevation of a portion of the postcard of FIGS. 3 and 4 showing a shaded plastic sheet.

Referring now to FIGS. 1 and 2 there is shown a first embodiment of a postcard in accordance with the instant invention. As seen in FIG. 1, the front side of the postcard includes a photograph 10 which is held beneath a plastic sheet 11 which may be either clear or shaded. The plastic sheet 11 is releasably secured by a layer of adhesive 12 secured to a display surface 13 of a relatively rigid panel 14 made of carboard or the like.

As is seen in FIG. 2, the relatively rigid panel 14 has a writing side 16 on the rear surface thereof which is divided into a message portion 17 and an address portion 18 by a line 19 delineated on the writing surface 16. Also, a small area 21 for a stamp may be delineated in the upper righthand corner of the writing surface.

Preferably, but not necessarily, the postcard has a width of $4\frac{1}{8}$ inches and a length of $5\frac{3}{4}$ inches in order to conform to general Post Office standards.

As is best seen in FIG. 5 and as is also practiced with the embodiment of FIGS. 1 and 2, the panel 14 has an outer area 22 upon which the adhesive 12 is fixed and an adhesive-free inner area 23 on which the photograph 10 is preferably mounted. The plastic sheet 11 is secured to the adhesive 12 only in the border area 22 which holds the photograph 10 in place in the inner area 23. Consequently, when the postcard arrives at its destination, the plastic sheet 11 may be stripped away from the pressure sensitive adhesive 12 and the panel 14 allowing the photograph 10 to be readily removed. In this way, the photograph 10 is not bent or damaged upon being removed and the adhesive area 12 provides a guide for positioning the photograph on the display surface 13 initially.

Referring again specifically to the embodiment set forth in FIGS. 1 and 2, while the panel 14 is shown composed of a front subpanel 14A and a rear subpanel 14B, it is also within the scope of this invention to make the panel 14 of a single piece of material instead of as a laminate.

While the adhesive 12 shown in FIG. 5 is confined to outer area 22 of the panel 14, it is within the scope of this invention to completely coat the panel 14 with adhesive so there is no adhesive-free area 23 and the photograph is mounted on the adhesive. Preferably, the adhesive 12 is pressure sensitive so that the photograph 10 may be readily peeled from the adhesive on the panel 14 after the plastic sheet is peeled.

In the embodiment of FIGS. 1 and 2, the plastic sheet 11 preferably has a portion 25 which is lapped around the panel 14 and adhered to the message surface 18 so that the plastic sheet is readily secured at one end to the panel and has a readily observable free end 26 which may be pried loose from the adhesive 12 in order to form a tab for pulling the sheet away from the rigid panel 14.

Referring now to FIGS. 3 and 4 where a second embodiment of the invention is shown, the panel 14 includes a rear subpanel 34 and a front subpanel 35. The rear and front subpanels 34 and 35 are each coated with the layer of permanent adhesive. The plastic sheet 11 has an excess portion 11A which preferably forms one-half of the area of the plastic sheet and is received between the front and rear panels 35 and 34, respectively. When the panels are pressed together, a laminate is formed which holds the plastic sheet 11 in place. The portion of the plastic sheet 11B which overlaps the photograph 10 is free so that it need not be adhered to the adhesive 12 of the display surface 13 until after the photograph 10 is positioned. If desired, prior to that time, the free portion 11B may be folded back over the writing surface 17 of the display panel when the postcard is packaged so that the pressuresensitive adhesive 12 may be protected by a shield (not shown) such as the shields used to protect the adhesive areas of bandaids. After the shield is stripped off, the portion 11B of the plastic sheet may be folded over the display surface 13 so as to be adhered to adhesive 12.

The rear subpanel 34 has a writing surface thereon similar in configuration to the writing surface 16 shown in FIG. 2. When the photograph 10 is in place on the front subpanel 25 and covered with the plastic sheet 11 the postcard has a front side which appears substantially the same as is shown in FIG. 1.

In FIG. 6 the plastic sheet 11*a* is shaded rather than being transparent.

The foregoing examples and illustrations are merely illustrative only of the principles of the invention. Further, since numerous modifications and changes will readily occur to those skilled in the art, it is not desired to limit the invention to the exact construction and operation as shown and described, and accordingly all suitable modifications and equivalents may be resorted to, fully within the scope of the invention.

I claim:

1. A postcard comprising:

a relatively rigid panel having front and back subpanels adhered together and having a writing surface on one side thereof and a display surface on the other side thereof;

a layer of adhesive disposed in an outer area of the display surface wherein the layer of adhesive has an inner margin which defines and adhesive free inner area of the display surface within which a photograph is positioned; and a plastic cover sheet placed over said display surface and adhered to said adhesive layer to hold said photograph in place within the adhesive free inner area between said plastic sheet and said display surface wherein the plastic sheet has an area greater than the area of the display surface which results in an excess area that is sandwiched between the front and back subpanels and wherein the plastic sheet is folded around one edge of the front subpanel, laid across the photograph and adhered to the layer of adhesive disposed on the outer area of the display surface.

2. The postcard of claim 1 wherein the plastic sheet is clear.

3. The postcard of claim 1 wherein the plastic sheet is shaded.

4. The postcard of claim 1 wherein a line is formed down the back side of the writing surface to define a message area and an address area.

5. The postcard of claim 1 wherein the excess area of the plastic sheet is substantially equal to the area of the display surface and is one-half the entire area of the plastic sheet.

6. The postcard of claim 1 wherein the layer of adhesive disposed in the outer area of the display surface is pressure sensitive.

7. A postcard comprising:

a relatively rigid panel having front and back subpanels adhered together and having a writing surface on one side thereof and a display surface on the other side thereof;

a layer of pressure sensitive adhesive disposed on the display surface for retaining a photograph thereon, and a plastic cover sheet placed over the said display surface and adhered to said adhesive layer to protect said photograph wherein the plastic sheet has an area greater than the areas of display surface which results in an excess area, that is sandwiched between the front and back subpanels and secured to the front panel on one side, and to the back panel on the other side, wherein the plastic sheet is folded around the bottom edge of the front subpanel, laid across the photograph and adhered to the layer of adhesive disposed on the display surface.

8. The postcard of claim 7 wherein the plastic sheet is clear.

9. The postcard of claim 7 wherein the excess area of the plastic sheet is substantially equal to the area of the display surface and is one-half the entire area of the plastic sheet.

* * * * *